US008449699B2

(12) United States Patent
Kizu et al.

(10) Patent No.: US 8,449,699 B2
(45) **Date of Patent: *May 28, 2013**

(54) COLD-ROLLED STEEL SHEET, METHOD FOR MANUFACTURING THE SAME, AND BACKLIGHT CHASSIS

(75) Inventors: Taro Kizu, Tokyo (JP); Koichiro Fujita, Tokyo (JP); Eiko Yasuhara, Tokyo (JP); Kazuhiro Hanazawa, Tokyo (JP); Masatoshi Kumagai, Tokyo (JP); Kenji Tahara, Tokyo (JP); Hideharu Koga, Tokyo (JP)

(73) Assignee: JFE Steel Corporation (JP)

( * ) Notice: Subject to any disclaimer, the term of this patent is extended or adjusted under 35 U.S.C. 154(b) by 3 days.

This patent is subject to a terminal disclaimer.

(21) Appl. No.: 13/054,971

(22) PCT Filed: Jul. 22, 2009

(86) PCT No.: PCT/JP2009/063451

§ 371 (c)(1),
(2), (4) Date: Jan. 20, 2011

(87) PCT Pub. No.: WO2010/010964

PCT Pub. Date: Jan. 28, 2010

(65) Prior Publication Data

US 2011/0120600 A1 May 26, 2011

(30) Foreign Application Priority Data

Jul. 22, 2008 (JP) ..... 2008-188889
Jun. 29, 2009 (JP) ..... 2009-154060

(51) Int. Cl.
*C22C 38/00* (2006.01)
*C21D 8/00* (2006.01)

(52) U.S. Cl.
USPC ..... 148/645; 148/320; 148/648

(58) Field of Classification Search
USPC ..... 148/320, 330, 645, 648, 650–654
See application file for complete search history.

(56) References Cited

FOREIGN PATENT DOCUMENTS

| | | | |
|---|---|---|---|
| EP | 1026278 | A1 * | 8/2000 |
| JP | 3-281732 | A | 12/1991 |
| JP | 2002-206138 | A | 7/2002 |
| JP | 2004-131771 | A | 4/2004 |
| JP | 3532138 | B2 | 5/2004 |
| JP | 2004-183057 | A | 7/2004 |
| WO | 00/06791 | A1 | 2/2000 |

* cited by examiner

*Primary Examiner* — Steven Bos
*Assistant Examiner* — Brian Walck
(74) *Attorney, Agent, or Firm* — DLA Piper LLP (US)

(57) ABSTRACT

A cold-rolled steel sheet includes, on a percent by mass basis: C: 0.0010% to 0.0030%, Si: 0.05% or less, Mn: 0.1% to 0.3%, P: 0.05% or less, S: 0.02% or less, Al: 0.02% to 0.10%, N: 0.005% or less, and Nb: 0.010% to 0.030% and the remainder composed of Fe and incidental impurities, wherein values in a rolling direction and a direction perpendicular to the rolling direction are within a range of 1.0 to 1.6, and a mean value $El_m$ of elongations in the rolling direction, a direction at 45° with respect to the rolling direction, and the direction perpendicular to the rolling direction is 40% or more, where $El_m=(El_L+2\times El_D+El_C)/4$ and $El_L$: elongation in the rolling direction, $El_D$: elongation in the direction at 45° with respect to the rolling direction, and $El_C$: elongation in the direction perpendicular to the rolling direction.

9 Claims, 3 Drawing Sheets

COLD-ROLLED STEEL SHEET, METHOD FOR MANUFACTURING THE SAME, AND BACKLIGHT CHASSIS

RELATED APPLICATIONS

This is a §371 of International Application No. PCT/JP2009/063451, with an international filing date of Jul. 22, 2009 (WO 2010/010964 A1, published Jan. 28, 2010), which is based on Japanese Patent Application Nos. 2008-188889, filed Jul. 22, 2008, and 2009-154060, filed Jun. 29, 2009, the subject matter of which is incorporated by reference.

TECHNICAL FIELD

This disclosure relates to a cold-rolled steel sheet excellent in workability and flatness and a method for manufacturing the same, and further relates to a backlight chassis by using the above-described cold-rolled steel sheet.

BACKGROUND

In recent years, along with the upsizing of liquid crystal televisions, a backlight chassis of the liquid crystal television has been upsized as well. The backlight chassis refers to a member which is disposed on the back side of a backlight for the liquid crystal television and which holds a liquid crystal panel and the above-described backlight from the back. The backlight chassis is required to have rigidity to support a light, flatness to avoid contacting the light against a liquid crystal portion, cracking, or the like, and no feeling of oil canning In addition, a reduction in thickness is desired for the purpose of slimming the television and a reduction in raw material cost.

However, along with the above-described upsizing and reduction in thickness of the backlight chassis, problems related to the rigidity and flatness have appeared. It is believed that formation of a bead by subjecting a flat plate surface of the above-described backlight chassis to stretch forming is effective to ensure the above-described rigidity. It was found, however, that working of the flat plate surface caused new problems, such as degradation in flatness and an increase in feeling of oil canning. The above-described degradation in flatness of the backlight chassis and the like are phenomena which occur because of poor shape fixability in pressure forming. Consequently, a steel sheet used for the backlight chassis has been required to have workability and, in addition, has been required to have shape fixability. Regarding the steel sheet which has been used previously, however, there is a problem in that the workability is provided to a certain extent, but sufficient shape fixability cannot be provided.

Examples of steel sheets provided with the above-described shape fixability include a steel sheet produced by a method in which the amount of spring back in bending is reduced by controlling aggregation texture and, in addition, specifying at least one of r values in the rolling direction and the direction perpendicular to the rolling direction to be 0.7 or less, as disclosed in, for example, Japanese Patent No. 3532138. In addition, a steel sheet in which spring back and wall camber in bending are suppressed by controlling the anisotropy of local elongation and uniform elongation, as disclosed in Japanese Unexamined Patent Application Publication No. 2004-183057, is included. Furthermore, a ferrite based thin steel sheet, in which spring back in bending can be suppressed by specifying the X-ray diffraction intensity ratio of the {100} face to the {111} face to be 1.0 or more, as disclosed in International Patent Publication No. WO 2000/6791, is included.

Each of the steel sheets of JP '138, JP '057 and WO '791 has the shape fixability in bending to a certain extent. However, there is a problem in that sufficient shape fixability is not obtained in the case of working, for example, stretch forming, where high ductility is required. Moreover, there is a problem in that the shape fixability is enhanced, but the rigidity and the workability of the steel sheet are degraded.

It could therefore be helpful to provide specified components and r values and, thereby, provide a cold-rolled steel sheet provided with excellent workability and shape fixability, a method for manufacturing the same, and a backlight chassis.

SUMMARY

We found that a cold-rolled steel sheet and a backlight chassis, which were provided with excellent workability and, in addition, which had both r values, in the rolling direction and the direction perpendicular to the rolling direction, specified to be within the range of 1.0 to 1.6 and excellent shape fixability, were obtained by employing steel containing c: 0.0010% to 0.0030%, Si: 0.05% or less, Mn: 0.1% to 0.3%, P: 0.05% or less, S: 0.02% or less, Al: 0.02% to 0.10%, N: 0.005% or less, and Nb: 0.010% to 0.030% on a percent by mass basis as a raw material and optimizing the production condition, in particular the annealing condition.

We thus provide:

(1) A cold-rolled steel sheet characterized by containing, on a percent by mass basis, C: 0.0010% to 0.0030%, Si: 0.05% or less, Mn: 0.1% to 0.3%, P: 0.05% or less, S: 0.02% or less, Al: 0.02% to 0.10%, N: 0.005% or less, Nb: 0.010% to 0.030% and the remainder composed of Fe and incidental impurities, wherein both r values in the rolling direction and the direction perpendicular to the rolling direction are within the range of 1.0 to 1.6, and the mean value $El_m$ of elongations in the rolling direction, the direction at 45° with respect to the rolling direction, and the direction perpendicular to the rolling direction is 40% or more, where $$El_m=(El_L+2\times El_D+El_C)/4$$

$El_L$: elongation in the rolling direction, $El_D$: elongation in the direction at 45° with respect to the rolling direction, and $El_C$: elongation in the direction perpendicular to the rolling direction.

(2) The cold-rolled steel sheet according to the above-described item (1), further containing B: 0.0003% to 0.0015% on a percent by mass basis.

(3) The cold-rolled steel sheet according to the above-described item (1), further containing Ti: 0.005% to 0.020% and B: 0.0003% to 0.0015% on a percent by mass basis.

(4) A backlight chassis for a liquid crystal television, produced by performing predetermined working through the use of the cold-rolled steel sheet according to any one of the above-described items (1), (2), and (3).

(5) A method for manufacturing a cold-rolled steel sheet, characterized by including the steps of subjecting a steel slab having the component composition according to any one of the above-described items (1), (2), and (3) to hot rolling, in which heating is performed at 1,200° C. or higher and, thereafter, finish rolling is completed at 870° C. to 950° C., so as to produce a hot-rolled sheet, taking up the resulting hot-rolled sheet at 450° C. to 750° C., performing pickling and, thereafter, performing cold rolling at a reduction ratio of 55% to 80%, so as to produce a cold-rolled sheet, and performing annealing, in which heating is performed at 1° C./sec to 30° C./sec over a temperature range from 600° C. to a predetermined soaking temperature, soaking is kept at the above-described predetermined soaking temperature for 30 to 200 seconds and, thereafter, cooling is performed to 600° C. at a mean cooling rate of 3° C./sec or more, wherein the above-described predetermined soaking temperature is within the range of (800−R+500×n)° C. to (800+1,000×n)° C., where the reduction ratio in the cold rolling is assumed to be R (%) and the Nb content in the steel slab is assumed to be n (percent by mass).

A cold-rolled steel sheet with excellent workability and shape fixability as compared with a conventional cold-rolled steel sheet and a method for manufacturing the same can be provided. In addition, a backlight chassis with excellent workability and shape fixability can also be provided.

DETAILED DESCRIPTION

Figure 1:
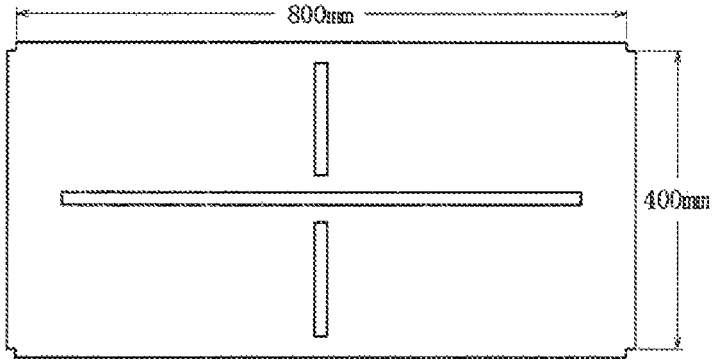
FIG. 1 is a plan view schematically showing a cold-rolled steel sheet subjected to press working to imitate a shape of a backlight chassis for a liquid crystal television on the order of 32V model.

Details are described below.

A cold-rolled steel sheet is characterized by containing, on a percent by mass basis, C: 0.0010% to 0.0030%, Si: 0.05% or less, Mn: 0.1% to 0.3%, P: 0.05% or less, S: 0.02% or less, Al: 0.02% to 0.10%, N: 0.005% or less, Nb: 0.010% to 0.030% and the remainder composed of Fe and incidental impurities, wherein both r values in the rolling direction and the direction perpendicular to the rolling direction are within the range of 1.0 to 1.6. C: 0.0010% to 0.0030%

The cold-rolled steel sheet contains C (carbon). Carbon is a component necessary for controlling the r value and improving the workability. Carbon forms a fine carbide with Nb described later, suppresses grain growth of ferrite during an annealing process after cold rolling and, in addition, controls the aggregation texture of ferrite, so that the r value of the steel sheet can be controlled.

In this regard, the carbon content is specified to be within the range of 0.0010% to 0.0030% because if the content is less than 0.0010%, the above-described grain growth of ferrite proceeds and, thereby, it is difficult to control the r value at a low level, so that desired shape fixability cannot be obtained. Furthermore, it is because if the content exceeds 0.0030%, solid solution carbon remains in the above-described steel sheet after hot rolling, introduction of shearing strain into grains is facilitated during cold rolling and, as a result, there is a problem in that the r value after annealing becomes low significantly. In addition, the above-described steel sheet is hardened due to the increases in solid solution carbon and the carbide and, as a result, the elongation is reduced and degradation of the workability occurs.

Moreover, the cold-rolled steel sheet is advantageous as compared with steel sheets having higher carbon contents because an ultra low carbon steel sheet having carbon content of 0.0010% to 0.0030% is used, as described above and, thereby, an occurrence of wrinkle, which becomes apparent easily on the basis of a thickness reduction, in forming of a backlight chassis is suppressed. That is, the above-described wrinkle in forming of the backlight chassis along with the thickness reduction occurs easily in a steel sheet having a larger yield elongation, whereas the steel sheet is excellent in aging resistance and can suppress an occurrence of yield elongation because the carbon content is optimized, and the amount of solid solution carbon can be reduced.

Si: 0.05% or less

Furthermore, it is necessary that the Si content of the cold-rolled steel sheet is specified to be 0.05% or less. If the Si content exceeds 0.05%, the workability is degraded because hardening proceeds excessively and, in addition, plating performance may be degraded because Si oxides are formed during annealing. Moreover, if the Si content is high, the temperature of transformation of the steel from austenite to ferrite increases during hot rolling and, thereby, completion of rolling in an austenite region becomes difficult. Consequently, it is necessary that the Si content is specified to be 0.05% or less and preferably the Si content is minimized.

Mn: 0.1% to 0.3%

In addition, the cold-rolled steel sheet contains Mn (Manganese). Manganese is a component necessary for reacting with S in the above-described steel to form MnS and, thereby, preventing a hot brittleness problem due to S, as described later, and the like.

The Mn content is specified to be 0.1% to 0.3% because if the content is less than 0.1%, the above-described problems resulting from S cannot be prevented sufficiently and, furthermore, if the content exceeds 0.3%, Mn becomes too much and, thereby, a problem may occur in that the steel sheet is hardened to degrade the workability or recrystallization of ferrite during annealing may be suppressed. In this regard, it is more preferable that the Mn content is specified to be 0.2% or less.

P: 0.05% or less

The P content in the cold-rolled steel sheet is specified to be 0.05% or less because if the content exceeds 0.05%, P is segregated and, thereby, the ductility and the toughness of the above-described steel sheet may be degraded. In addition, for the same reason, it is more preferable that the content is specified to be 0.03% or less and is preferably minimized.

S: 0.02% or less

If a large amount of S is contained in the above-described steel sheet, the ductility is reduced significantly, cracking may occur in hot rolling or cold rolling and, thereby, the surface shape may be degraded significantly. Furthermore, S hardly contributes to the strength of the above-described steel sheet and, in addition, S serves as an impurity element to form coarse MnS and cause a problem in that the elongation is reduced. Consequently, it is necessary that the S content is specified to be 0.02% or less and preferably the S content is minimized. This is because if the S content exceeds 0.02%, the above-described problems tend to occur remarkably.

Al: 0.02% to 0.10%

The cold-rolled steel sheet contains Al (Aluminum). Aluminum is a component necessary for reacting with N described below to immobilize N as a nitride and, thereby, suppressing age hardening due to solid solution N.

The Al content is specified to be 0.02% to 0.10% because if the Al content is less than 0.02%, it is not possible to react with N, described above, sufficiently to suppress age hardening and, furthermore, if the content exceeds 0.10%, the temperature of transformation of the steel from austenite to ferrite increases during hot rolling and, thereby, completion of hot rolling in an austenite region becomes difficult.

N: 0.005% or Less

It is necessary that the N content is specified to be 0.005% or less, and preferably the N content is minimized. This is because if the N content exceeds 0.005%, slab cracking may result during hot rolling and a surface flaw may occur and, furthermore, in the case where N is present as solid solution N after cold rolling and annealing, age hardening may occur.

Nb: 0.010% to 0.030%

The cold-rolled steel sheet contains Nb. As with carbon described above, Nb is a component necessary for controlling the r value and improving the workability, forms a fine carbide with carbon described above, suppresses grain growth of ferrite during an annealing process after cold rolling and, in addition, controls the aggregation texture of ferrite, so that the r value of the steel sheet can be controlled at a low level.

The Nb content is specified to be 0.010% to 0.030% because if the content is less than 0.010%, the above-described grain growth of ferrite proceeds and, thereby, it is difficult to control the r value at a low level, so that desired shape fixability cannot be obtained. Furthermore, it is because if the content exceeds 0.030%, a carbonitride of Nb or solid solution Nb increases to harden the above-described steel sheet and, as a result, elongation is reduced and degradation of the workability occurs. In this regard, the amount of Nb is further preferably 0.020% or less.

It is preferable that the cold-rolled steel sheet further contains B: 0.0003% to 0.0015% on a percent by mass basis or further contains Ti: 0.005% to 0.02% and B: 0.0003% to 0.0015%.

B: 0.0003% to 0.0015%

Boron is present as solid solution B to suppress recrystallization of austenite in hot rolling and, thereby, facilitate ferrite transformation from unrecrystallized austenite during cooling after finish rolling to develop an aggregation texture advantageous for reduction in r value, so that increases in r values in the rolling direction and the direction perpendicular to the rolling direction after cold rolling and annealing can be suppressed. If the B content is less than 0.0003%, the above-described effect cannot be exerted, and if the content exceeds 0.0015%, not only the effect is saturated, but also the rolling load increases due to suppression of recrystallization.

Ti: 0.005% to 0.02% and B: 0.0003% to 0.0015%

In the case where B is present as solid solution B in the steel sheet after cold rolling, grain growth of the above-described ferrite can be suppressed during the annealing process after the cold rolling and the r value can be controlled at a low level. To obtain such effects of B during the annealing process after the cold rolling, it is necessary to add Ti: 0.005% to 0.02% and, in addition, satisfy B: 0.0003% to 0.0015%. In the case where Ti is not added, B forms a nitride easily at the stage of taking up after the hot rolling and, thereby, it becomes difficult to ensure solid solution B sufficiently. Ti is bonded to N described above to form a nitride and reduce solid solution N and, thereby, exerts an effect of suppressing formation of the nitride of B when B is added and allowing added B to serve as solid solution B.

The Ti content is specified to be within the range of 0.005% to 0.02% because if the content is less than 0.005%, the above-described effect of reducing solid solution N is not exerted sufficiently and, furthermore, if the content exceeds 0.02%, Ti is bonded to C to form a carbide and suppress formation of the fine carbide of Nb described above, so that the r value may not be controlled at a low level.

In addition, in the case where Ti is added, the B content is specified to be within the range of 0.0003% to 0.0015% because if the content is less than 0.0003%, the above-described effect of suppressing ferrite grain growth during the annealing process after the cold rolling cannot be exerted sufficiently and, furthermore, if the content exceeds 0.0015%, the above-described effect of suppressing ferrite grain growth becomes too large, so that the aggregation texture of ferrite may not be controlled.

However, addition of Ti is not specifically necessary to obtain only the above-described effect of solid solution B at the stage of hot rolling, and even when Ti is added, the effect is not changed.

The remainder other than the above-described components of the cold-rolled steel sheet is composed of Fe and incidental impurities. The incidental impurities contained in the above-described steel sheet refer to very small amounts of elements. They are, for example, Cr, Ni and Cu.

We conducted research on the cold-rolled steel sheet provided with excellent workability and shape fixability by specifying the individual components and the r values.

As a result, we found that a cold-rolled steel sheet with excellent workability and, in addition, excellent shape fixability while ensuring the flatness sufficient for a backlight chassis was obtained by providing specific contents of the above-described components (C, Si, Mn, P, S, Al, N, and Nb) and specifying both r values in the rolling direction and the direction perpendicular to the rolling direction to be within the range of 1.0 to 1.6.

The relationship between the r value and the flatness in the case where forming into the shape of a backlight chassis was performed will be described below.

Figure 2:
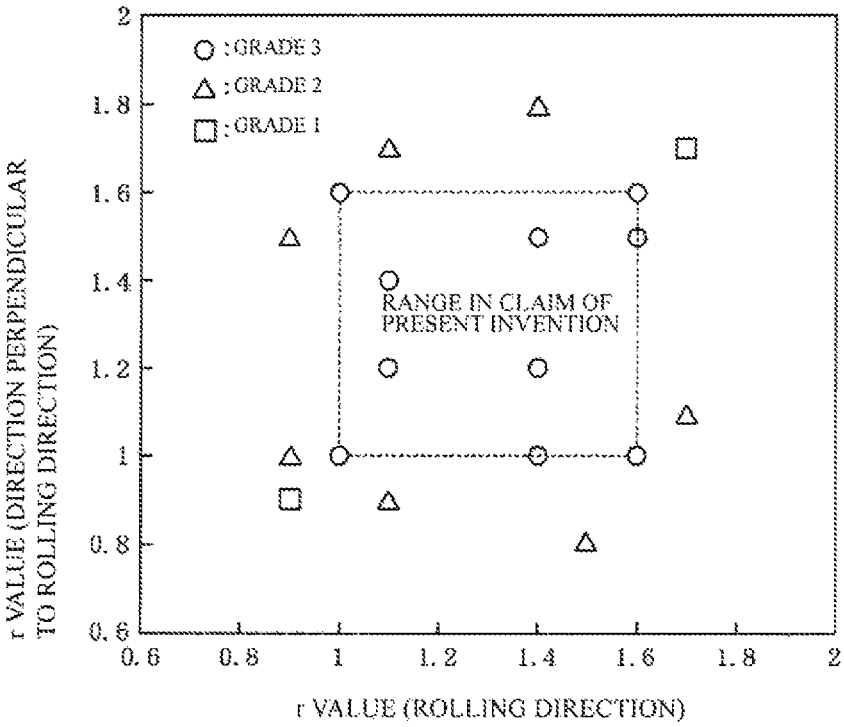
FIG. 2 is a graph showing the influence of the r values in the rolling direction and the direction perpendicular to the rolling direction on the flatness grade regarding a cold-rolled steel sheet.

An electroplated steel sheet having a sheet thickness of 0.8 mm, produced by subjecting a cold-rolled steel sheet to electrogalvanization, was cut into the size shown in FIG. 1 in such a way that the short side pointed in the rolling direction. Thereafter, 10 mm each of edges of four sides were raised at an angle of 90° and, in addition, one bead of 20×700 mm with a height of 5 mm and two beads of 20×150 mm with a height of 5 mm were attached in such a way that the surface opposite to the side, on which the edges were stood, became convex as shown in FIG. 1 through press working to imitate the shape of a backlight chassis for a 32V liquid crystal television. The sheet after the press was placed on a platen with the side, on which the edges were stood, down and the flatness was evaluated on the basis of the state of floating. Then, evaluation was performed such that the case where there was almost no floating and the flatness was excellent was given with a grade 3, the case where floating of about several millimeters was observed partly was given with a grade 2, and the case where the whole member was warped significantly was given with a grade 1. FIG. 2 shows the influence of the r values in the rolling direction and the direction perpendicular to the rolling direction on the flatness grade. It is clear that the flatness can be ensured by specifying the r values to be 1.0 to 1.6 which is in our range.

As described above, the r values in the rolling direction and the direction perpendicular to the rolling direction are specified to be within the range of 1.6 or less and, thereby, in working of the steel sheet, inflow of the above-described steel sheet materials into worked portions (for example, corner portions in bending) can be suppressed to a certain extent. As a result, excellent shape fixability is exhibited and, in addition, the flatness can be ensured. The lower limit of the r value is specified to be 1.0 and, thereby, it is suppressed that the strain in the sheet thickness direction becomes large as compared with the strain in the sheet width direction. Consequently, degradation in rigidity along with the reduction in sheet thickness of the above-described worked portion is suppressed and high flatness can be provided while a certain level of workability is ensured.

Furthermore, it is necessary that the mean value $El_m$ of elongations in the rolling direction, the direction at 45° with respect to the rolling direction, and the direction perpendicular to the rolling direction, represented by the following formula, is specified to be 40% or more:

$$El_m=(El_L+2\times El_D+El_C)/4$$

$El_L$: elongation in the rolling direction $El_D$: elongation in the direction at 45° with respect to the rolling direction $El_C$: elongation in the direction perpendicular to the rolling direction.

The above-described mean value of elongations is specified to be 40% or more because if the value is less than 40%, the stretch forming required to ensure the rigidity of the backlight chassis becomes difficult.

In this regard, a backlight chassis for a liquid crystal television, having excellent workability and shape fixability, can be obtained by subjecting the cold-rolled steel sheet to a predetermined working, for example, bending or stretch working. The use of the resulting backlight chassis is effective to provide good flatness and reduce oil canning. The cold-rolled steel sheet is suitable for the backlight chassis, but is not limited to the above application.

The method for manufacturing the cold-rolled steel sheet includes the steps of subjecting a steel slab having the above-described component composition to hot rolling, in which heating is performed at 1,200° C. or higher and, thereafter, finish rolling is completed at 870° C. to 950° C. to produce a hot-rolled sheet, taking up the resulting hot-rolled sheet at 450° C. to 750° C., performing pickling and, thereafter, performing cold rolling at a reduction ratio of 55% to 80%, so as to produce a cold-rolled sheet, and performing annealing, in which heating is performed at 1° C./sec to 30° C./sec over a temperature range from 600° C. to a predetermined soaking temperature, soaking is kept at the predetermined soaking temperature for 30 to 200 seconds and, thereafter, cooling is performed to 600° C. at a mean cooling rate of 3° C./sec or more.

In the above-described step to form the hot-rolled sheet, the heating temperature of the above-described steel slab is specified to be 1,200° C. or higher because it is necessary to allow the carbide of Nb to form a solid solution once during heating and precipitate finely after taking up in the hot rolling and a temperature of 1,200° C. or higher is required to form the solid solution of the above-described carbide of Nb. Furthermore, the temperature of completion of the above-described finish rolling is specified to be within the range of 870° C. to 950° C. The reason is as described below. If the temperature of completion of the finish rolling is lower than 870° C., the finish rolling is completed while the texture of the above-described hot-rolled sheet is in the state of ferrite range in some cases.

A change from the austenite range to the ferrite range occurs during the finish rolling and, thereby, the rolling load may decrease sharply, the load control of a rolling machine may become difficult, and breakage and the like may occur. In this regard, the risk of breakage can be avoided by passing the sheet, which is in the ferrite range at the inlet side of rolling, but there is a problem in that the texture of the above-described hot-rolled sheet becomes unrecrystallized ferrite and the load during the cold rolling increases. On the other hand, if the temperature exceeds 950° C., crystal grains of austenite become coarse, crystal grains of ferrite resulting from the following transformation become coarse and, thereby, crystal rotation during cold rolling becomes insufficient. As a result, development of the aggregation texture of ferrite is suppressed and the r value is reduced.

In the above-described step to form the cold-rolled sheet, the above-described take-up temperature is specified to be 450° C. to 750° C. because if the temperature is lower than 450° C., acicular ferrite is generated and, thereby, the steel sheet may be hardened and an inconvenience may occur in the following cold rolling. On the other hand, it is because if the temperature exceeds 750° C., precipitates of NbC tend to become coarse and, thereby, control of formation of the above-described fine carbide becomes difficult in the above-described step of annealing after the above-described cold rolling, and the r value cannot be reduced. In this regard, the take-up temperature is preferably 680° C. or lower.

Moreover, the pickling is performed to remove scale on the hot-rolled sheet surface. The pickling condition may be pursuant to a usual way. In addition, the reduction ratio in the above-described cold rolling is specified to be within the range of 55% to 80% because if the reduction ratio is less than 55%, crystal rotation due to rolling becomes insufficient and, thereby, an aggregation texture of ferrite cannot be developed sufficiently. On the other hand, it is because if the reduction ratio exceeds 80%, the above-described aggregation texture is developed excessively and, as a result, the r values in the rolling direction and the direction perpendicular to the rolling direction exceed 1.6, which is the upper limit.

In the above-described step to perform annealing, the rate of heating from 600° C. to the soaking temperature is specified to be 1° C./sec to 30° C./sec because if the heating rate is less than 1° C./sec, the heating rate is too small and, therefore, the above-described fine carbide becomes coarse and the above-described effect of suppressing the grain growth of ferrite cannot be exerted. On the other hand, it is because if the heating rate exceeds 30° C./sec, the heating rate is too large, recovery during heating is suppressed and, as a result, the grain growth of the above-described ferrite proceeds easily in the following soaking so that the aggregation texture of ferrite cannot be controlled.

Moreover, the time of the above-described keeping of soaking is specified to be 30 to 200 seconds. This is because if the time is less than 30 seconds, the above-described recrystallization of ferrite is not completed in some cases and grain growth is suppressed so that the r value cannot be controlled and the elongation is reduced. On the other hand, it is because if the time exceeds 200 seconds, the soaking time is long, the above-described grains grow excessively large, so that the aggregation texture of ferrite cannot be controlled. In addition, the mean rate of cooling from the above-described soaking temperature to 600° C. is specified to be 3° C./sec or more because if the cooling rate is less than 3° C./sec, the growth of the above-described ferrite grains is facilitated and, thereby, the aggregation texture of ferrite cannot be controlled. In this regard, the upper limit of the above-described cooling rate is not particularly specified, but about 30° C./sec is preferable from the viewpoint of cooling facilities.

Then, the method for manufacturing the cold-rolled steel sheet is characterized in that the above-described predetermined soaking temperature is within the range of (800−R+500×n)° C. to (800+1,000×n)° C., where the reduction ratio in the cold rolling is assumed to be R (%) and the Nb content in the steel slab is assumed to be n (percent by mass). Regarding the soaking temperature, we expected as described below from the viewpoint of the r value and the elongation characteristic. Initially, in the soaking after heating, the r value can be controlled and, in addition, the elongation can be improved by completing recrystallization and, in addition, effecting grain growth to a small extent. In this connection, as the reduction ratio in the cold rolling (may be referred to as a "cold-rolling reduction ratio") becomes low and the amount of Nb becomes large, an occurrence of recrystallization becomes difficult and an occurrence of grain growth also becomes difficult, so that soaking at a higher temperature is required. Therefore, it is necessary that the soaking temperature is specified to be higher than or equal to the predetermined temperature in accordance with the cold-rolling reduction ratio R (%) and the amount of Nb (%). On the other hand, if the soaking temperature is high, grains grow to become large, so that the aggregation texture cannot be controlled. In this connection, grains grow easily as the amount of Nb becomes smaller so that it is necessary that the soaking temperature is specified to be lower than or equal to the predetermined temperature in accordance with the amount of Nb (%).

Figure 3:
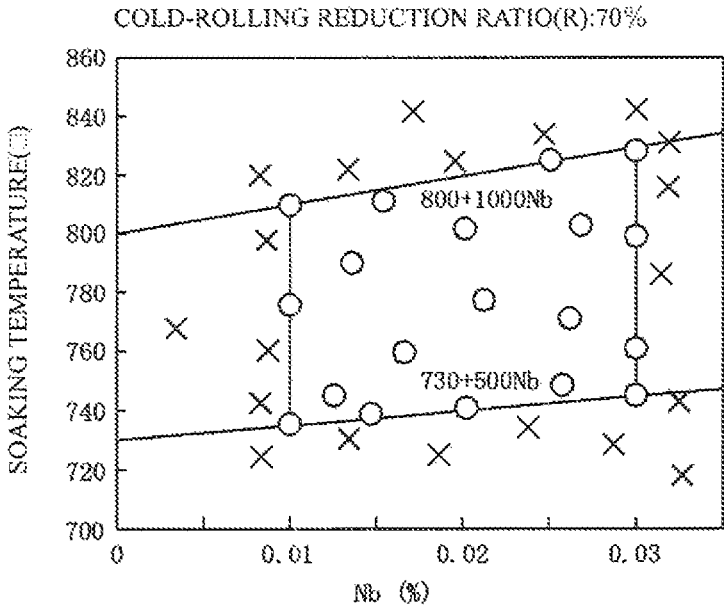
FIG. 3 is a graph showing the result of whether the r values and the mean elongation $El_m$ are good or no good in the case where the cold-rolling reduction ratio is specified to be 70% (constant) and the amount of Nb and the soaking temperature are changed regarding a cold-rolled steel sheet.
Figure 4:
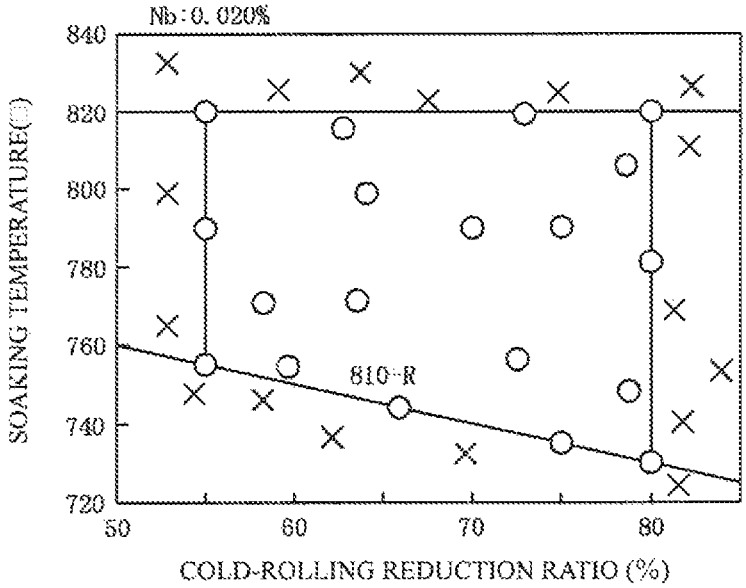
FIG. 4 is a graph showing the result of whether the r values and the mean elongation $El_m$ are good or no good in the case where the amount of Nb is specified to be 0.020% (constant) and the cold-rolling reduction ratio and the soaking temperature are changed regarding a cold-rolled steel sheet.

The relationship of the r value and the elongation with the amount of Nb, the cold-rolling reduction ratio, and the soaking temperature were examined on the basis of the above-described examination. FIG. 3 shows the relationship of the r value and the mean elongation $El_m$ with the amount of Nb and the soaking temperature, where the cold-rolling reduction ratio is 70%. FIG. 4 shows the relationship of the r value and the mean elongation with the cold-rolling reduction ratio and the soaking temperature, where the amount of Nb is 0.020%. The cold-rolled sheet having a thickness of 0.6 to 1.0 mm was produced while all of the other conditions were within our range. The point, at which both r values in the rolling direction and the direction perpendicular to the rolling direction are 1.0 to 1.6 and the mean value $El_m$ of elongations is 40% or more, is indicated by a symbol ○, and the case where any one of the r values and the elongation are out of our range is indicated by a symbol x.

It was made clear from FIG. 3 and FIG. 4 that the r values and the elongation were able to become within our range by specifying the soaking temperature to be (800−R+500×n)° C. to (800+1,000×n)° C., where the Nb content is assumed to be n (percent by mass) and the cold-rolling reduction ratio is assumed to be R (%). If the soaking temperature is less than (800−R+500×n)° C. or exceeds (800+1,000×n)° C., the r values and the elongation within our range cannot be realized.

The above-described soaking temperature is specified to be within the above-described range and, thereby, recrystallization of ferrite is completed and grain growth of the above-described ferrite is specified so that the r value can be controlled at a low level and the elongation characteristic can be improved.

In this regard, the conditions other than the above-described production conditions may be pursuant to a usual way. For example, as for a melting method, a common converter process, electric furnace process, or the like can be applied appropriately. The melted steel is cast into a slab and, then is subjected to hot rolling on an "as-is" basis or after being cooled and heated. In the hot rolling, after finishing is performed under the above-described finish condition, taking up is performed at the above-described take-up temperature. The cooling rate after the finish rolling to the taking up is not particularly specified, but it is enough that the cooling rate is larger than or equal to the air-cooling rate. In this connection, quenching may be performed at 100° C./s or more, as necessary. Subsequently, the above-described cold rolling is performed after common pickling.

As for the annealing, heating and cooling under the above-described conditions are performed. Any cooling rate is employed in the region lower than 600° C., and as necessary, hot dip galvanization may be performed at about 480° C. In this regard, after the plating, reheating to 500° C. or higher may be performed to alloying the plating. Alternatively, a heat history, in which, for example, keeping is performed during the cooling, may be provided. Furthermore, about 0.5% to 2% of temper rolling may be performed, as necessary. Moreover, in the case where plating is not performed during the annealing, electrogalvanization or the like may be performed to improve the corrosion resistance. In addition, a coating film may be formed on a cold-rolled steel sheet or a plated steel sheet by a chemical conversion treatment or the like.

The above description is no more than an exemplification of possible steel sheets and methods, and various modifications can be made within the scope of the appended Claims.

EXAMPLES

Examples will be described.

After steel slabs containing the components shown in Table 1-1 and Table 1-2 were melted, the slabs were heated for 1 hour at heating temperatures (° C.) shown in the Tables. Subsequently, hot rolling, in which finish rolling was completed at finish temperatures (° C.) shown in Table 1-1 and Table 1-2, was performed to obtain hot-rolled sheets (sheet thickness: 2.0 to 3.5 mm). Thereafter, the resulting hot-rolled sheets were taken up at take-up temperatures (° C.) shown in Table 1-1 and Table 1-2, pickling was performed. Then, cold rolling was performed at reduction ratios shown in Table 1-1 and Table 1-2 to obtain cold-rolled sheets (sheet thickness: 0.6 to 1.0 mm). After the cold rolling, an annealing step was performed with mean heating rates (° C./sec) from 600° C. to the soaking temperature, soaking temperatures (° C.), soaking times (sec), and mean cooling rates (° C./sec) from the soaking temperature to 600° C. shown in Table 1-1 and Table 1-2 to obtain Specimens 1 to 45. In this regard, cooling from 600° C. to room temperature was performed at a similar cooling rate. Furthermore, after the annealing, temper rolling was performed at a reduction ratio of 1.0%.

Table 1-1 and Table 1-2 show the composition of contained elements (C, Si, Mn, P, S, Al, N, Nb, Ti, and B), the production condition (heating temperature in hot rolling, finish temperature and take-up temperature, reduction ratio in cold rolling, as well as heating temperature, soaking temperature, soaking time, cooling rate, A: (800−R+500×n), and B: (800+1,000×n) in annealing) with respect to each of Specimens 1 to 45.

Evaluation

Regarding the resulting each Specimen, (1) Regarding each Specimen, JIS No. 5 test pieces for tensile test were cut in the rolling direction and the direction perpendicular to the rolling direction. The gauge length ($L_0$) and the sheet width ($W_0$) were measured, a tensile test was performed at a tensile speed of 10 mm/min and prestrain (elongation) of 15% and, thereafter, the gauge length (L) and the sheet width (W) were measured again. The r value was calculated on the basis of the following formula:

$$r=\ln(W/W_0)/\ln(W_0L_0/WL).$$

(2) Regarding each Specimen, JIS No. 5 test pieces for tensile test were cut in the rolling direction, the direction at 45° with respect to the rolling direction, and the direction perpendicular to the rolling direction. A tensile test of each test piece was performed at a tensile speed of 10 mm/min. Thereafter, the elongation was measured, and the mean value $El_m$ (%) of elongations was calculated on the basis of the following formula:

$$El_m=(El_L+2\times El_D+El_C)/4$$

$El_L$: elongation in the rolling direction, $El_D$): elongation in the direction at 45° with respect to the rolling direction, and $El_C$: elongation in the direction perpendicular to the rolling direction.

The results of the r values and mean elongations obtained in the items (1) and (2) are shown in Table 1-1 and Table 1-2.

Figure 5:
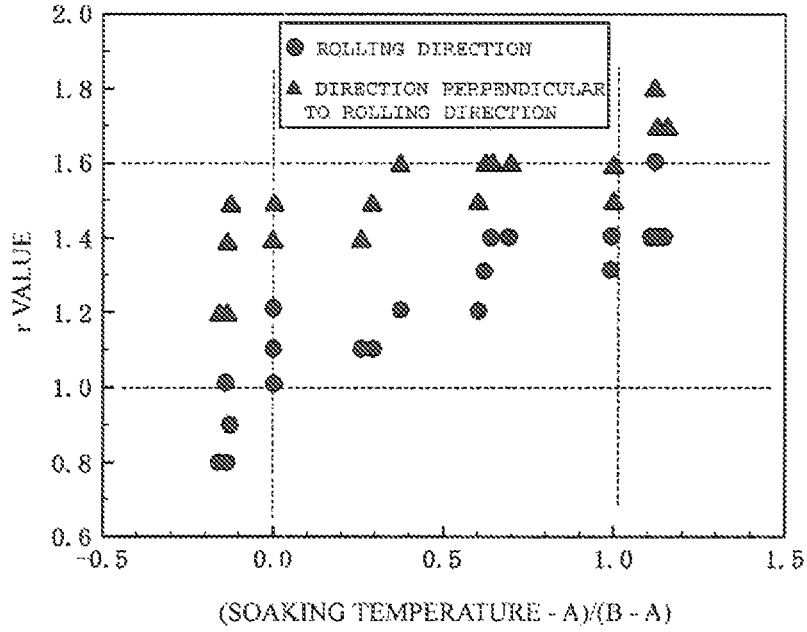
FIG. 5 is a graph showing the relationship between (soaking temperature−A)/(B−A) and the r value, where the value of (800−R+500×n) is assumed to be A, and the value of (800+1,000×n) is assumed to be B regarding Specimens 1 to 26 in the Example.
Figure 6:
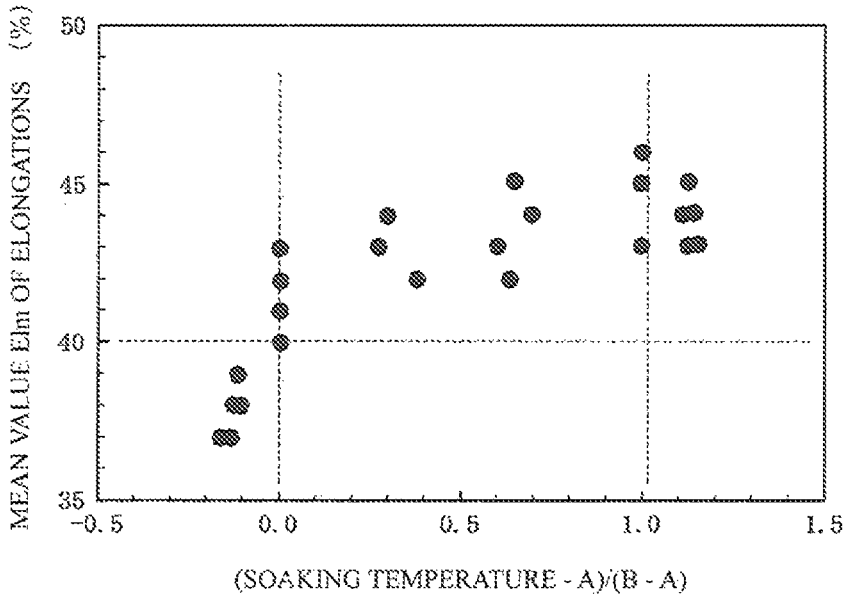
FIG. 6 is a graph showing the relationship between (soaking temperature−A)/(B−A) and the mean value (%) of elongations, where the value of (800−R+500×n) is assumed to be A, and the value of (800+1,000×n) is assumed to be B regarding Specimens 1 to 26 in the Example.

Furthermore, based on Specimens 1 to 26, FIG. 5 was made showing the relationship between (soaking temperature−A)/(B−A) and the r value, and FIG. 6 was made showing the relationship between (soaking temperature−A)/(B−A) and the mean value (%) of elongations, where the value of (800−R+500×n) was assumed to be A, and the value of (800+1,000×n) was assumed to be B. The case where (soaking temperature−A)/(B−A) is 0 to 1.0 shows our range.

TABLE 1-1(a)

| Specimen | Chemical component (percent by mass) | | | | | | | | | |
|---|---|---|---|---|---|---|---|---|---|---|
| No. | C | Si | Mn | P | S | Al | N | Nb | Ti | B |
| 1 | 0.0015 | 0.01 | 0.15 | 0.01 | 0.005 | 0.03 | 0.003 | 0.020 | 0.015 | 0.0006 |
| 2 | 0.0020 | 0.03 | 0.20 | 0.01 | 0.011 | 0.02 | 0.004 | 0.020 | 0.010 | 0.0003 |
| 3 | 0.0010 | 0.02 | 0.10 | 0.02 | 0.020 | 0.08 | 0.002 | 0.020 | 0.015 | 0.0015 |
| 4 | 0.0025 | 0.05 | 0.20 | 0.04 | 0.013 | 0.10 | 0.001 | 0.020 | 0.005 | 0.0015 |
| 5 | 0.0025 | 0.01 | 0.10 | 0.01 | 0.017 | 0.02 | 0.003 | 0.020 | 0.011 | 0.0008 |
| 6 | 0.0030 | 0.04 | 0.15 | 0.01 | 0.013 | 0.03 | 0.002 | 0.020 | — | — |
| 7 | 0.0010 | 0.02 | 0.30 | 0.02 | 0.004 | 0.02 | 0.005 | 0.020 | — | — |
| 8 | 0.0015 | 0.03 | 0.20 | 0.01 | 0.007 | 0.03 | 0.003 | 0.020 | 0.011 | 0.0007 |
| 9 | 0.0020 | 0.02 | 0.30 | 0.01 | 0.010 | 0.04 | 0.004 | 0.020 | 0.012 | 0.0008 |
| 10 | 0.0030 | 0.03 | 0.15 | 0.01 | 0.019 | 0.02 | 0.003 | 0.020 | — | — |
| 11 | 0.0012 | 0.01 | 0.10 | 0.05 | 0.011 | 0.03 | 0.002 | 0.020 | 0.014 | 0.0011 |
| 12 | 0.0018 | 0.01 | 0.10 | 0.01 | 0.012 | 0.05 | 0.002 | 0.020 | — | — |
| 13 | 0.0022 | 0.02 | 0.10 | 0.01 | 0.013 | 0.02 | 0.001 | 0.020 | 0.015 | 0.0012 |
| 14 | 0.0028 | 0.01 | 0.15 | 0.02 | 0.020 | 0.03 | 0.002 | 0.020 | — | — |
| 15 | 0.0023 | 0.04 | 0.15 | 0.01 | 0.010 | 0.02 | 0.001 | 0.010 | — | — |
| 16 | 0.0022 | 0.05 | 0.15 | 0.01 | 0.008 | 0.04 | 0.002 | 0.010 | 0.015 | 0.0011 |
| 17 | 0.0021 | 0.02 | 0.20 | 0.02 | 0.007 | 0.02 | 0.003 | 0.010 | 0.014 | 0.0012 |
| 18 | 0.0018 | 0.01 | 0.25 | 0.03 | 0.006 | 0.03 | 0.002 | 0.010 | — | — |
| 19 | 0.0016 | 0.01 | 0.20 | 0.01 | 0.005 | 0.05 | 0.001 | 0.010 | 0.011 | 0.0004 |
| 20 | 0.0025 | 0.01 | 0.30 | 0.01 | 0.004 | 0.06 | 0.002 | 0.010 | 0.018 | 0.0007 |
| 21 | 0.0023 | 0.02 | 0.25 | 0.02 | 0.001 | 0.02 | 0.002 | 0.030 | — | — |
| 22 | 0.0022 | 0.01 | 0.20 | 0.02 | 0.005 | 0.04 | 0.002 | 0.030 | 0.015 | 0.0004 |
| 23 | 0.0018 | 0.01 | 0.12 | 0.02 | 0.002 | 0.05 | 0.001 | 0.030 | 0.010 | 0.0005 |
| 24 | 0.0022 | 0.02 | 0.18 | 0.01 | 0.002 | 0.06 | 0.003 | 0.030 | 0.008 | 0.0003 |
| 25 | 0.0023 | 0.01 | 0.27 | 0.02 | 0.003 | 0.07 | 0.002 | 0.030 | — | — |
| 26 | 0.0011 | 0.01 | 0.16 | 0.03 | 0.005 | 0.08 | 0.005 | 0.030 | 0.011 | 0.0008 |
| 27 | 0.0015 | 0.01 | 0.15 | 0.01 | 0.005 | 0.03 | 0.003 | 0.019 | 0.015 | 0.0006 |
| 28 | 0.0022 | 0.02 | 0.18 | 0.02 | 0.012 | 0.02 | 0.004 | 0.022 | — | — |
| 29 | 0.0023 | 0.02 | 0.27 | 0.05 | 0.008 | 0.03 | 0.002 | 0.023 | 0.011 | 0.0005 |
| 30 | 0.0018 | 0.03 | 0.22 | 0.01 | 0.002 | 0.04 | 0.003 | 0.024 | 0.012 | 0.0006 |

TABLE 1-2(a)

| Specimen | Chemical component (percent by mass) | | | | | | | | | |
|---|---|---|---|---|---|---|---|---|---|---|
| No. | C | Si | Mn | P | S | Al | N | Nb | Ti | B |
| 31 | 0.0023 | 0.01 | 0.21 | 0.01 | 0.003 | 0.05 | 0.002 | 0.018 | — | — |
| 32 | 0.0032 | 0.01 | 0.26 | 0.02 | 0.005 | 0.04 | 0.004 | 0.027 | — | — |
| 33 | 0.0008 | 0.01 | 0.22 | 0.02 | 0.006 | 0.04 | 0.002 | 0.013 | 0.012 | 0.0005 |
| 34 | 0.0022 | 0.02 | 0.24 | 0.01 | 0.003 | 0.03 | 0.003 | 0.008 | 0.015 | 0.0009 |
| 35 | 0.0023 | 0.01 | 0.17 | 0.01 | 0.007 | 0.02 | 0.004 | 0.032 | — | — |
| 36 | 0.0023 | 0.02 | 0.24 | 0.03 | 0.008 | 0.05 | 0.003 | 0.017 | — | — |
| 37 | 0.0014 | 0.02 | 0.22 | 0.01 | 0.009 | 0.04 | 0.002 | 0.018 | — | — |
| 38 | 0.0011 | 0.01 | 0.23 | 0.01 | 0.011 | 0.04 | 0.003 | 0.019 | 0.012 | 0.0011 |
| 39 | 0.0015 | 0.01 | 0.22 | 0.02 | 0.011 | 0.03 | 0.001 | 0.015 | 0.013 | 0.0008 |
| 40 | 0.0015 | 0.02 | 0.20 | 0.01 | 0.010 | 0.03 | 0.002 | 0.021 | 0.010 | 0.0012 |
| 41 | 0.0013 | 0.02 | 0.22 | 0.01 | 0.010 | 0.03 | 0.002 | 0.021 | 0.010 | 0.0010 |
| 42 | 0.0017 | 0.01 | 0.23 | 0.01 | 0.004 | 0.04 | 0.003 | 0.027 | — | 0.0007 |
| 43 | 0.0012 | 0.01 | 0.25 | 0.01 | 0.006 | 0.05 | 0.002 | 0.022 | — | 0.0003 |
| 44 | 0.0015 | 0.01 | 0.15 | 0.01 | 0.005 | 0.05 | 0.001 | 0.015 | — | 0.0010 |
| 45 | 0.0011 | 0.01 | 0.26 | 0.01 | 0.004 | 0.06 | 0.001 | 0.025 | — | 0.0015 |

TABLE 1-1(b)

| Hot rolling-Cold rolling step | | | | Annealing | | | | | | |
|---|---|---|---|---|---|---|---|---|---|---|
| Heating temperature (° C.) | Finish temperature (° C.) | Take-up temperature (° C.) | Reduction ratio in cold rolling (%) | Heating rate (° C./sec) | Soaking temperature (° C.) | Soaking time (sec) | Cooling rate (° C./sec) | A | B | (Soaking temperature-A)/(B-A_ |
| 1250 | 890 | 650 | 70 | 10 | 770 | 130 | 20 | 740 | 820 | 0.38 |
| 1200 | 870 | 450 | 70 | 20 | 740 | 30 | 30 | 740 | 820 | 0.00 |
| 1230 | 910 | 550 | 70 | 30 | 790 | 60 | 10 | 740 | 820 | 0.63 |
| 1200 | 930 | 750 | 70 | 1 | 820 | 100 | 3 | 740 | 820 | 1.00 |
| 1210 | 890 | 600 | 70 | 8 | 730 | 150 | 15 | 740 | 820 | −0.13 |
| 1220 | 880 | 620 | 70 | 7 | 830 | 130 | 10 | 740 | 820 | 1.13 |
| 1260 | 950 | 630 | 55 | 3 | 755 | 150 | 5 | 755 | 820 | 0.00 |
| 1280 | 910 | 580 | 55 | 15 | 800 | 200 | 8 | 755 | 820 | 0.69 |
| 1230 | 920 | 620 | 55 | 21 | 830 | 200 | 8 | 755 | 820 | 1.15 |
| 1240 | 920 | 630 | 55 | 25 | 745 | 150 | 5 | 755 | 820 | −0.15 |
| 1200 | 930 | 500 | 65 | 25 | 745 | 120 | 12 | 745 | 820 | 0.00 |
| 1210 | 910 | 730 | 65 | 13 | 790 | 180 | 15 | 745 | 820 | 0.60 |
| 1200 | 900 | 670 | 65 | 18 | 735 | 130 | 21 | 745 | 820 | −0.13 |
| 1200 | 920 | 620 | 65 | 17 | 830 | 80 | 20 | 745 | 820 | 1.13 |
| 1230 | 910 | 630 | 70 | 18 | 735 | 160 | 25 | 735 | 810 | 0.00 |
| 1240 | 920 | 590 | 70 | 15 | 755 | 120 | 5 | 735 | 810 | 0.27 |
| 1210 | 910 | 520 | 70 | 14 | 780 | 140 | 28 | 735 | 810 | 0.60 |
| 1200 | 910 | 610 | 70 | 7 | 810 | 90 | 17 | 735 | 810 | 1.00 |
| 1200 | 920 | 670 | 70 | 8 | 820 | 80 | 15 | 735 | 810 | 1.13 |
| 1230 | 930 | 600 | 70 | 19 | 725 | 150 | 16 | 735 | 810 | −0.13 |
| 1210 | 910 | 690 | 70 | 5 | 745 | 160 | 21 | 745 | 830 | 0.00 |
| 1230 | 890 | 470 | 70 | 24 | 770 | 120 | 8 | 745 | 830 | 0.29 |
| 1210 | 880 | 610 | 70 | 17 | 800 | 170 | 7 | 745 | 830 | 0.65 |
| 1200 | 900 | 540 | 70 | 15 | 830 | 130 | 12 | 745 | 830 | 1.00 |
| 1210 | 910 | 500 | 70 | 18 | 735 | 140 | 30 | 745 | 830 | −0.12 |
| 1230 | 920 | 550 | 70 | 22 | 840 | 50 | 25 | 745 | 830 | 1.12 |
| 1250 | 890 | 650 | 70 | 0.7 | 770 | 130 | 20 | 740 | 819 | 0.38 |
| 1230 | 900 | 610 | 66 | 35 | 760 | 160 | 26 | 745 | 822 | 0.19 |
| 1240 | 910 | 540 | 67 | 21 | 780 | 25 | 21 | 745 | 823 | 0.45 |
| 1250 | 920 | 450 | 58 | 2 | 800 | 220 | 14 | 754 | 824 | 0.66 |

TABLE 1-2(b)

| Hot rolling-Cold rolling step | | | | Annealing | | | | | | |
|---|---|---|---|---|---|---|---|---|---|---|
| Heating temperature (° C.) | Finish temperature (° C.) | Take-up temperature (° C.) | Reduction ratio in cold rolling (%) | Heating rate (° C./sec) | Soaking temperature (° C.) | Soaking time (sec) | Cooling rate (° C./sec) | A | B | (Soaking temperature-A)/(B-A_ |
| 1230 | 910 | 640 | 63 | 5 | 795 | 110 | 2 | 746 | 818 | 0.68 |
| 1230 | 920 | 610 | 66 | 4 | 765 | 120 | 13 | 748 | 827 | 0.22 |
| 1210 | 920 | 620 | 66 | 15 | 780 | 150 | 12 | 741 | 813 | 0.54 |
| 1200 | 910 | 550 | 68 | 9 | 785 | 80 | 21 | 736 | 808 | 0.68 |
| 1230 | 930 | 600 | 74 | 5 | 750 | 110 | 15 | 742 | 832 | 0.09 |
| 1210 | 910 | 770 | 71 | 15 | 755 | 100 | 9 | 738 | 817 | 0.22 |
| 1200 | 960 | 620 | 62 | 14 | 785 | 100 | 16 | 747 | 818 | 0.54 |
| 1200 | 900 | 610 | 53 | 21 | 760 | 90 | 27 | 757 | 819 | 0.06 |
| 1210 | 910 | 570 | 82 | 17 | 740 | 30 | 22 | 726 | 815 | 0.16 |
| 1200 | 910 | 590 | 80 | 24 | 740 | 50 | 23 | 731 | 821 | 0.10 |
| 1200 | 910 | 580 | 75 | 21 | 750 | 60 | 23 | 736 | 821 | 0.17 |
| 1250 | 900 | 550 | 70 | 10 | 790 | 130 | 20 | 744 | 827 | 0.56 |
| 1250 | 890 | 560 | 70 | 12 | 780 | 130 | 15 | 741 | 822 | 0.48 |
| 1250 | 910 | 550 | 75 | 10 | 760 | 120 | 20 | 733 | 815 | 0.33 |
| 1250 | 900 | 570 | 70 | 8 | 800 | 150 | 25 | 743 | 825 | 0.70 |

TABLE 1-1(c)

| Evaluation | | | |
|---|---|---|---|
| r value (rolling direction) | r value (direction perpendicular to rolling direction) | Elongation mean value (%) | Remarks |
| 1.2 | 1.6 | 42 | Example |
| 1.0 | 1.2 | 41 | Example |
| 1.3 | 1.6 | 42 | Example |
| 1.4 | 1.6 | 43 | Example |
| 0.9 | 1.4 | 38 | Comparative example |
| 1.6 | 1.8 | 45 | Comparative example |
| 1.0 | 1.4 | 40 | Example |
| 1.4 | 1.6 | 44 | Example |
| 1.4 | 1.7 | 43 | Comparative example |
| 0.8 | 1.2 | 37 | Comparative example |
| 1.1 | 1.5 | 42 | Example |
| 1.2 | 1.5 | 43 | Example |
| 1.0 | 1.4 | 38 | Comparative example |
| 1.4 | 1.7 | 44 | Comparative example |
| 1.0 | 1.5 | 41 | Example |
| 1.1 | 1.4 | 43 | Example |
| 1.2 | 1.5 | 43 | Example |
| 1.4 | 1.6 | 45 | Example |
| 1.4 | 1.7 | 43 | Comparative example |
| 0.8 | 1.2 | 37 | Comparative example |
| 1.2 | 1.5 | 43 | Example |
| 1.1 | 1.5 | 44 | Example |
| 1.4 | 1.6 | 45 | Example |
| 1.3 | 1.5 | 46 | Example |
| 0.9 | 1.5 | 39 | Comparative example |
| 1.4 | 1.8 | 44 | Comparative example |
| 1.3 | 1.7 | 43 | Comparative example |
| 1.2 | 1.7 | 43 | Comparative example |
| 1.0 | 1.5 | 38 | Comparative example |
| 1.4 | 1.8 | 45 | Comparative example |

TABLE 1-2(c)

| Evaluation | | | |
|---|---|---|---|
| r value (rolling direction) | r value (direction perpendicular to rolling direction) | Elongation mean value (%) | Remarks |
| 1.3 | 1.7 | 43 | Comparative example |
| 0.7 | 1.0 | 37 | Comparative example |
| 1.6 | 2.0 | 48 | Comparative example |
| 1.6 | 1.8 | 45 | Comparative example |
| 1.2 | 1.4 | 39 | Comparative example |
| 1.4 | 1.8 | 44 | Comparative example |
| 0.8 | 1.4 | 43 | Comparative example |
| 0.9 | 1.4 | 42 | Comparative example |
| 1.4 | 1.8 | 43 | Comparative example |
| 1.2 | 1.6 | 42 | Example |
| 1.2 | 1.5 | 42 | Example |
| 1.2 | 1.6 | 43 | Example |
| 1.1 | 1.5 | 42 | Example |
| 1.2 | 1.6 | 43 | Example |
| 1.1 | 1.6 | 42 | Example |

It was made clear from Table 1-1 and Table 1-2 that regarding the cold-rolled steel sheet of each example, the r value was within the range of 1.0 to 1.6, the mean value of the mean elongations was 40% or more and, therefore, excellent workability and shape fixability were provided.

Moreover, it was made clear from FIG. 5 that the r value became within the range of 1.0 to 1.6 in the case where the value of (soaking temperature−A)/(B−A) was within the range of 0 to 1.0. In addition, it was made clear from FIG. 6 that the mean value of elongations became 40% or more in the case where the value of (soaking temperature−A)/(B−A) was within the range of 0 to 1.0.

As is clear from the above-described results, the r value and the mean value of elongations of each cold-rolled steel sheet become within the respective desired ranges in the case where the value of the soaking temperature is within the range of A to B, i.e., (800−R+500×n) to (800+1,000×n).

Furthermore, a backlight chassis for a 32V liquid crystal television was formed by using the cold-rolled steel sheet. The backlight chassis was able to be formed without causing any problem regarding both the workability and the flatness.

INDUSTRIAL APPLICABILITY

A cold-rolled steel sheet with excellent workability and shape fixability as compared with a conventional cold-rolled steel sheet and a method for manufacturing the same can be provided. In addition, a backlight chassis with excellent workability and shape fixability can also be provided.

The invention claimed is:

1. A cold-rolled steel sheet comprising, on a percent by mass basis:

C: 0.0010% to 0.0030%, Si: 0.05% or less, Mn: 0.1% to 0.3%, P: 0.05% or less, S: 0.02% or less, Al: 0.02% to 0.10%, N: 0.005% or less, and Nb: 0.010% to 0.030% and the remainder composed of Fe and incidental impurities, wherein values in a rolling direction and a direction perpendicular to the rolling direction are within a range of 1.0 to 1.6, and a mean value $El_m$ of elongations in the rolling direction, a direction at 45° with respect to the rolling direction, and the direction perpendicular to the rolling direction is 40% or more, where $$El_m=(El_L+2\times El_D+El_C)/4$$

$El_L$: elongation in the rolling direction $El_D$: elongation in the direction at 45° with respect to the rolling direction $El_C$: elongation in the direction perpendicular to the rolling direction.

2. The cold-rolled steel sheet according to claim 1, further comprising:

B: 0.0003% to 0.0015% on a percent by mass basis.

3. The cold-rolled steel sheet according to claim 1, further comprising:

Ti: 0.005% to 0.020% and B: 0.0003% to 0.0015% on a percent by mass basis.

4. A backlight chassis for a liquid crystal television, produced by performing predetermined working of the cold-rolled steel sheet according to claim 1.

5. A backlight chassis for a liquid crystal television, produced by performing predetermined working of the cold-rolled steel sheet according to claim 2.

6. A backlight chassis for a liquid crystal television, produced by performing predetermined working of the cold-rolled steel sheet according to claim 3.

7. A method for manufacturing the cold rolled steel sheet of claim 1 comprising:

subjecting a steel slab having a component composition according to claim 1 to hot rolling, in which heating is performed at 1,200° C. or higher and, thereafter, finish rolling is completed at 870° C. to 950° C. to produce a hot-rolled sheet;

taking up the hot-rolled sheet at 450° C. to 750° C.;

pickling the hot rolled steel sheet;

performing cold rolling at a reduction ratio of 55% to 80% to produce a cold-rolled sheet;

performing annealing in which heating is performed at 1° C./sec to 30° C./sec over a temperature range from 600° C. to a predetermined soaking temperature, soaking is kept at the predetermined soaking temperature for 30 to 200 seconds; and cooling is performed to 600° C. at a mean cooling rate of 3° C./sec or more, wherein the predetermined soaking temperature is within the range of (800−R+500×n)° C. to (800+1,000×n)° C., where the reduction ratio in the cold rolling is R (%) and the Nb content in the steel slab is n (percent by mass).

8. A method for manufacturing the cold rolled steel sheet of claim 2 comprising:

subjecting a steel slab having a component composition according to claim 2 to hot rolling, in which heating is performed at 1,200° C. or higher and, thereafter, finish rolling is completed at 870° C. to 950° C. to produce a hot-rolled sheet;

taking up the hot-rolled sheet at 450° C. to 750° C.;

pickling the hot rolled steel sheet;

performing cold rolling at a reduction ratio of 55% to 80% to produce a cold-rolled sheet;

performing annealing in which heating is performed at 1° C./sec to 30° C./sec over a temperature range from 600° C. to a predetermined soaking temperature, soaking is kept at the predetermined soaking temperature for 30 to 200 seconds; and cooling is performed to 600° C. at a mean cooling rate of 3° C./sec or more, wherein the predetermined soaking temperature is within the range of (800−R+500×n)° C. to (800+1,000×n)° C., where the reduction ratio in the cold rolling is R (%) and the Nb content in the steel slab is n (percent by mass).

9. A method for manufacturing the cold rolled steel sheet of claim 3 comprising:

subjecting a steel slab having a component composition according to claim 3 to hot rolling, in which heating is performed at 1,200° C. or higher and, thereafter, finish rolling is completed at 870° C. to 950° C. to produce a hot-rolled sheet;

taking up the hot-rolled sheet at 450° C. to 750° C.;

pickling the hot rolled steel sheet;

performing cold rolling at a reduction ratio of 55% to 80% to produce a cold-rolled sheet;

performing annealing in which heating is performed at 1° C./sec to 30° C./sec over a temperature range from 600° C. to a predetermined soaking temperature, soaking is kept at the predetermined soaking temperature for 30 to 200 seconds; and cooling is performed to 600° C. at a mean cooling rate of 3° C./sec or more, wherein the predetermined soaking temperature is within the range of (800−R+500×n)° C. to (800+1,000×n)° C., where the reduction ratio in the cold rolling is R (%) and the Nb content in the steel slab is n (percent by mass).

* * * * *